US008112013B2

(12) United States Patent
Ikezaki

(10) Patent No.: US 8,112,013 B2
(45) Date of Patent: Feb. 7, 2012

(54) IMAGE FORMING DEVICE

(75) Inventor: Yoshiyuki Ikezaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 379 days.

(21) Appl. No.: 12/552,921

(22) Filed: Sep. 2, 2009

(65) Prior Publication Data

US 2010/0067940 A1 Mar. 18, 2010

(30) Foreign Application Priority Data

Sep. 12, 2008 (JP) ..... 2008-235025

(51) Int. Cl.
*G03G 15/00* (2006.01)

(52) U.S. Cl. ..... 399/107; 399/110; 399/111; 399/119; 399/120

(58) Field of Classification Search ..... 399/107, 399/110, 111, 119, 120, 262
See application file for complete search history.

(56) References Cited

U.S. PATENT DOCUMENTS

| | | | | |
|---|---|---|---|---|
| 6,104,897 | A | 8/2000 | Ishizawa | |
| 6,453,135 | B1 * | 9/2002 | Sameshima et al. | 399/110 |
| 7,466,939 | B2 * | 12/2008 | Nakashima et al. | 399/111 |
| 7,522,858 | B2 * | 4/2009 | Okabe et al. | 399/110 |
| 7,693,478 | B2 * | 4/2010 | Tanaka et al. | 399/358 |
| 7,773,911 | B2 * | 8/2010 | Kawamura | 399/110 |
| 2007/0077087 | A1 * | 4/2007 | Okabe et al. | 399/111 |
| 2007/0230998 | A1 | 10/2007 | Ishii | |
| 2007/0280730 | A1 * | 12/2007 | Okabe et al. | 399/111 |
| 2008/0025749 | A1 * | 1/2008 | Igarashi | 399/92 |
| 2008/0260419 | A1 * | 10/2008 | Seike et al. | 399/110 |
| 2008/0292355 | A1 * | 11/2008 | Sakurai et al. | 399/110 |

FOREIGN PATENT DOCUMENTS

| | | | |
|---|---|---|---|
| JP | H05-246557 | A | 9/1993 |
| JP | H10-198169 | A | 7/1998 |
| JP | H11-052816 | A | 2/1999 |
| JP | 2006-030810 | A | 2/2006 |
| JP | 2007-271763 | A | 10/2007 |
| JP | 2007-290825 | A | 11/2007 |
| JP | 2007-316367 | A | 12/2007 |

OTHER PUBLICATIONS

Japan Patent Office, Notification of Reasons of Rejection in counterpart Patent Application No. JP 2008-235025, mailed Jul. 6, 2010.

* cited by examiner

*Primary Examiner* — David Gray
*Assistant Examiner* — Francis Gray
(74) *Attorney, Agent, or Firm* — Baker Botts L.L.P.

(57) ABSTRACT

An image forming device includes a frame, a subunit detachably attached to the frame, a frame-side positioning portion, a subunit-side positioning portion, the subunit being positioned relative to the frame by making the subunit-side positioning portion contact the frame-side positioning portion, a contact regulating member attached to the frame movably between a location to contact the subunit before the subunit-side positioning portion comes into contact with the frame-side positioning portion in process of the subunit being attached to the frame from a detached state and a location to be kept from contacting the subunit, a pressing member attached to the frame movably between a position to press the subunit such that the subunit-side positioning portion is made contact the frame-side positioning portion and a position to be kept from pressing the subunit, and an interlocking member interlocking movements of the contact regulating member and the pressing member.

8 Claims, 5 Drawing Sheets

UP
DOWN
LEFT
RIGHT
FRONT
REAR
50
51
52
53
54
55
56
70
72
72A
73
74
81
82
86
87
88
89

IMAGE FORMING DEVICE

CROSS-REFERENCE TO RELATED APPLICATION

This application claims priority under 35 U.S.C. §119 from Japanese Patent Application No. 2008-235025 filed on Sep. 12, 2008. The entire subject matter of the application is incorporated herein by reference.

BACKGROUND

1. Technical Field

The following description relates to one or more image forming devices provided with an image forming unit configured to form an image on a recording sheet, more particularly to one or more image forming devices provided with the image forming unit at least part of which is configured as a separate subunit detachably supported by one or more frames.

2. Related Art

So far an image forming device has been proposed that includes an image forming unit, supported by one or more frames, at least part of which unit is configured as a separate subunit supported by the frames so as to be inserted into and pulled from the frame. For example, in a tandem-type laser printer that has four sets of a photoconductive drum and a development cartridge serially aligned, such a configuration has been proposed that the four sets of the photoconductive drum and the development cartridge are provided as an integrated subunit configured to be inserted into and pulled from one or more frames. In this case, the four sets of the photoconductive drum and the development cartridge can integrally be pulled from the frames, and thus such a configuration leads to easier maintenance of the image forming device.

Further, in the image forming device of this kind, a technique has been proposed in which the position of the subunit in the frames is determined by bringing a subunit-side positioning portion provided to the subunit into contact with a frame-side positioning portion provided to the frames. For instance, a technique has been proposed in which the position of the subunit in the frame is determined by engaging a notched portion as the subunit-side positioning portion that is formed at a leading end of the subunit in an inserting direction with a reference shaft as the frame-side positioning portion that links between right and left frames.

Moreover, in the image forming device of this kind, a configuration has been proposed to certainly determine the position of the subunit, which configuration has a pressing member configured to press the subunit in such a direction as to bring the subunit-side positioning portion into contact with the frame-side positioning portion. Furthermore, in the image forming device of this kind, a configuration has been proposed to prevent the subunit-side positioning portion from colliding against the frame-side positioning portion when the subunit is set in, which configuration has a contact regulating member configured to regulate the contact of the subunit-side positioning portion with the frame-side positioning portion.

SUMMARY

However, when the pressing member and the contact regulating member are separately provided, it results in a higher manufacturing cost and more difficult operations for the pressing member and the contact regulating member when the subunit is attached or detached.

Aspects of the present invention are advantageous to provide one or more improved image forming devices each of which includes a contact regulating member configured to regulate contact of a subunit-side positioning portion with a frame-side positioning portion and a pressing member configured to press an subunit in such a direction as to bring the subunit-side positioning portion into contact with the frame-side positioning portion, and each of which makes it possible to present a lower manufacturing cost and a more improved operationality of the image forming device.

According to aspects of the present invention, an image forming device is provided, which includes a frame, a subunit detachably attached to the frame, a frame-side positioning portion provided to the frame, a subunit-side positioning portion provided to the subunit, the subunit-side positioning portion being configured to position the subunit relative to the frame by establishing contact with the frame-side positioning portion, a contact regulating member attached to the frame movably between a first location where the contact regulating member establishes contact with the subunit before the subunit-side positioning portion comes into contact with the frame-side positioning portion in process of the subunit being attached to the frame from a detached state and a second location where the contact regulating member is kept from contacting the subunit, a pressing member attached to the frame movably between a first position where the pressing member presses the subunit in such a first direction as to bring the subunit-side positioning portion into contact with the frame-side positioning portion and a second position where the pressing member is kept from pressing the subunit, and an interlocking member configured to interlock movement of the contact regulating member to the first location with movement of the pressing member to the first position and to interlock movement of the contact regulating member to the second location with movement of the pressing member to the second position.

BRIEF DESCRIPTION OF THE ACCOMPANYING DRAWINGS

FIG. 1 schematically shows an internal configuration of an image forming device in an embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Overall Configuration of Laser Printer

Figure 1:
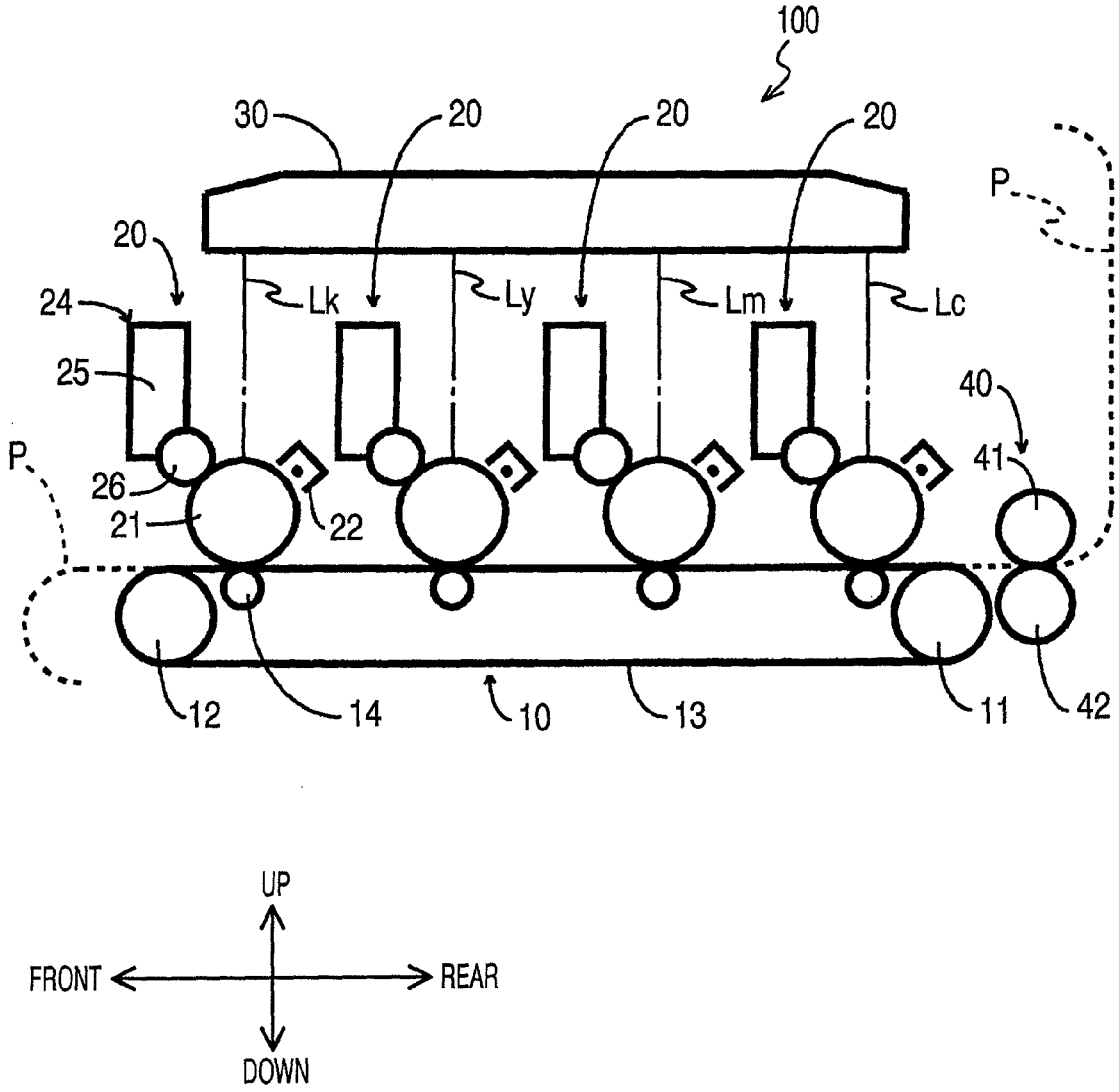

Hereinafter, an embodiment according to aspects of the present invention will be described with reference to the accompanying drawings. FIG. 1 schematically shows an internal configuration of an image forming device 100 in an embodiment. It is noted that the following description will be given with the left side in FIG. 1 defined as the front side of the image forming device 100. Further, FIG. 1 schematically shows a configuration of each element with the configuration partially omitted for the sake of explanatory convenience, and the figure is not necessarily consistent with other drawings.

As illustrated in FIG. 1, the image forming device 100 of the embodiment includes a belt unit 10 configured with a feeding belt (transfer belt) 13 wound around a driving roller 11 and a driven roller 12, and four process units 20, corresponding to four colors of black (K), yellow (Y), magenta (M), and cyan (C), respectively, which are disposed above the belt unit 10. The four process units 20 are aligned in a front-to-rear direction in the order of the black (K), yellow (Y), magenta (M), and cyan (C) from the front side, and thus configured as a direct tandem color image forming unit. In addition, the four process units 20 are respectively held by four containers (not shown) provided to a drum subunit 50 (see FIG. 2), in an individually attachable and detachable manner.

Each of the process units 20 is configured with a photoconductive drum 21, a scorotron charger 22, and a development cartridge 24. The photoconductive drum 21 includes a metal drum body connected to ground with a surface thereof covered with a positively-electrifiable photoconductive layer.

The scorotron charger 22 is disposed a predetermined distance away from the photoconductive drum 21, at an obliquely upper rear side of the photoconductive drum 21, so as to face the photoconductive drum 21. The scorotron charger 22 is configured to cause an electrification wire thereof such as a tungsten wire to generate corona discharge and to charge the surface of the photoconductive drum 21 positively and evenly. The development cartridge 24 has a toner container 25 provided therein. The development cartridge 24 is a known one configured to positively charge, in a frictional manner, one-component positively-electrifiable nonmagnetic toner of a corresponding one color of the black (K), cyan (C), magenta (M), and yellow (Y), which is stored in the toner container 25 and to supply the toner to the photoconductive drum 21 via a development roller 26.

Further, the belt unit 10 has four transfer rollers 14 provided to face the photoconductive drums 21 across the feeding belt 13, respectively. The feeding belt 13 is driven to turn in the clockwise direction in FIG. 1 by clockwise rotation of the driving roller 11. A sheet P is fed onto the surface of the feeding belt 13 by various rollers (not shown) such as a feed roller, from a feed tray (no shown) inserted into a lower portion of the image forming device 100. Then, the sheet P is conveyed to the rear side of the image forming device 100, passing through a position to face each photoconductive drum 21.

A scanner unit 30 is provided above the process units 20. The scanner unit 30, which is a known one configured to scan and expose the photoconductive drums 21, includes semiconductor lasers (not shown) configured to emit laser beams Lk, Ly, Lm, and Lc corresponding to four colors of image data, respectively, and polygon mirrors (not shown) configured to deflect the laser beams L (Lk, Ly, Lm, and Lc), respectively.

Therefore, first, the surface of each photoconductive drum 21 is charged evenly and positively by the charger 22 while being rotating. Thereafter, the surface of the photoconductive drum 21 is exposed through high-speed scanning of the laser beam L emitted by the scanner unit 30, and thus an electrostatic latent image, which corresponds to an image to be formed on the sheet P, is formed on the surface of the photoconductive drum 21. Subsequently, the positively charged toner held on the development roller 26 is supplied to the electrostatic latent image formed on the surface of the photoconductive drum 21 through rotation of the development roller 26 when facing and contacting the photoconductive drum 21. Thereby, the electrostatic latent image on the photoconductive drum 21 is developed into a visible image as a toner image formed with the toner attached to exposed portions on the surface of the photoconductive drum 21.

After that, the toner image held on the surface of each photoconductive drum 21 is sequentially transferred onto the sheet P by a negative transfer bias applied to the transfer roller 14 under constant current control when the sheet P being conveyed by the feeding belt 13 passes between the photoconductive drum 21 and the transfer roller 14. Next, the sheet P with the toner transferred thereon in this manner is conveyed to a fixing unit 40 provided behind the belt unit 10.

The fixing unit 40 includes a heating roller 41 that is provided with a heat source and configured to be rotated, and a pressing roller 42 that is disposed below the heating roller 41 so as to face and press the heating roller 41 and configured to be rotated in accordance with rotation of the heating roller 41. The fixing unit 40 heats the sheet P with four colors of toner images formed thereon while pinching and conveying between the heating roller 41 and the pressing roller 42, and thus thermally fixes the toner images on the sheet P. Then, the sheet P with the toner images thermally fixed thereon is ejected by various rollers (not shown) onto a catch tray (not shown) provided on an upper surface of the image forming device 100.

Configuration of Main Body Frame

As illustrated in FIGS. 2A to 2D, the drum subunit 50 in which the four process units 20 are stored is configured as a ship-shaped container with an upper side thereof opened. The drum subunit 50 is supported by a pair of metal plate frames 70 provided at right and left sides in the image forming device 100 so as to be inserted and pulled relative to the frames 70 in the front-to-rear direction. The drum subunit 50 has a handle 51 provided at the center of a front end. Gripping the handle 51, at the front side of the image forming device 100, a user can insert into or pull from between the metal plate frames 70. Further, the following configuration is not shown in any drawings, but the aforementioned scanner unit 30 is disposed above the metal plate frames 70, and an outer surface of each metal plate frame 70 is covered with a resin exterior cover. When a front cover provided to the exterior cover in an openable and closable manner is opened, the drum subunit 50 can be inserted and pulled relative to the metal plate frames 70 at the front side of the image forming device 100.

Figures 2A, 2B, 2C, 2D:
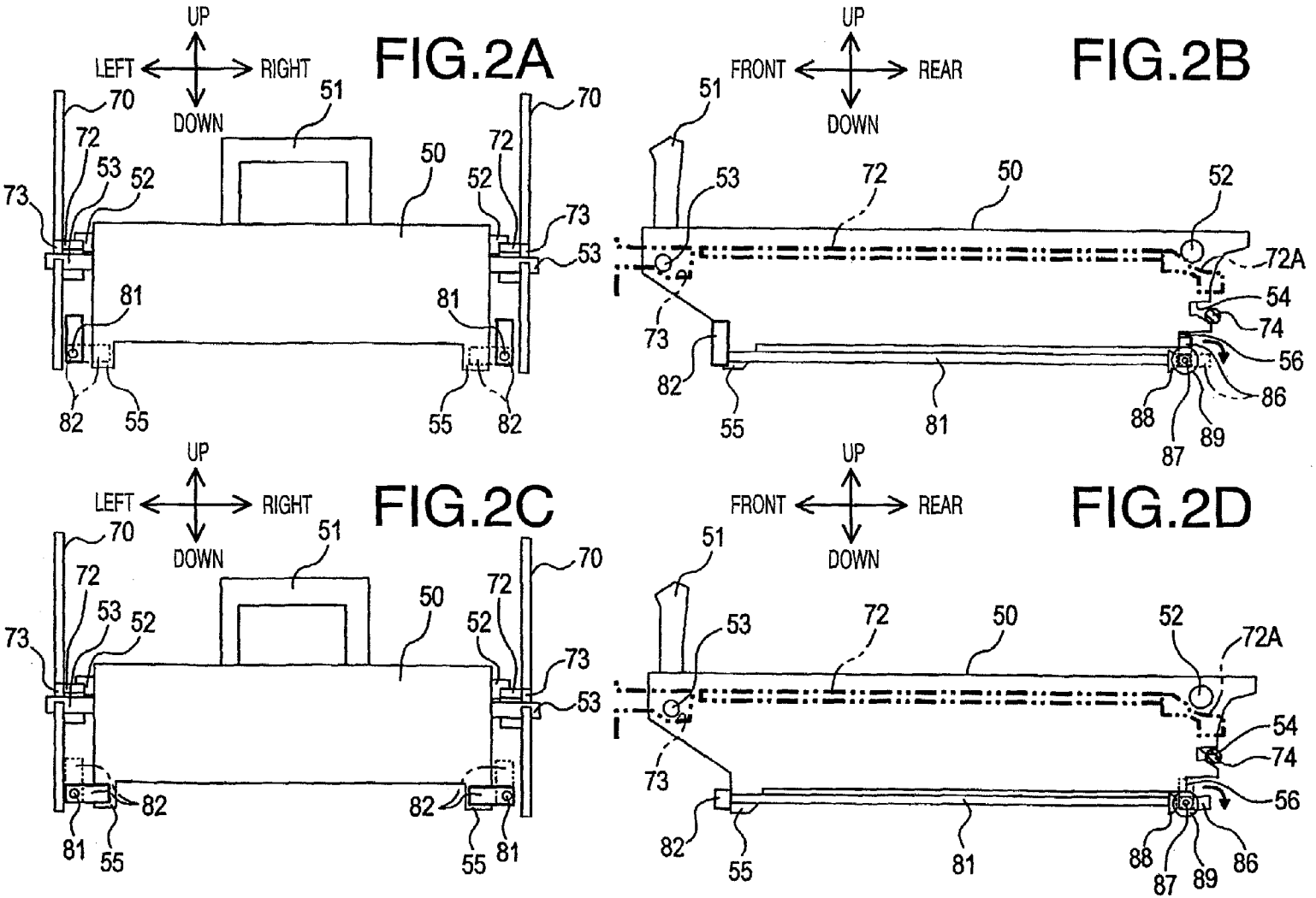
FIGS. 2A and 2B are respectively a front view and a side view of a drum subunit immediately after being inserted between metal plate frames in the embodiment according to one or more aspects of the present invention.
FIGS. 2C and 2D are respectively a front view and a side view of the drum subunit completely set between metal plate frames in the embodiment according to one or more aspects of the present invention.

FIG. 2A is a front view of the drum subunit 50 immediately after being inserted between the metal plate frames 70. FIG. 2B is a side view showing a configuration of the drum subunit 50 in the same state as above and surrounding members. As illustrated in FIGS. 2A and 2B, rollers 52 are disposed at an upper rear end so as to protrude from a right side face and a left side face, respectively. Each of the metal plate frames 70 is provided with a guide 72 configured to guide a corresponding one of the rollers 52 in the front-to-rear direction. Each of the metal plate frames 70 is configured as a plate that vertically stands and faces the other. The guides 72 are respectively provided on inner surfaces of the metal plate frames 70 and configured to protrude inward. An upper surface of each guide 72 that supports the roller 52 is configured with most thereof provided horizontally in the front-to-rear direction and a rear end thereof inclined down (inclined portion 72A). Therefore, when the drum subunit 50 is pushed rearward to a certain degree and the rollers 52 are put onto the inclined portions, the drum subunit 50 is guided further rearward owing to its own weight.

Further, the drum subunit 50 has supporting shafts 53 provided at the front end thereof, which are configured to protrude from the right and left side faces of the drum subunit 50, respectively. Each of the metal plate frames 70 has a supporting shaft insertion hole 73 formed at a front end thereof, which is open forward such that the supporting shaft 53 is inserted thereinto from the front side. A lower end of each supporting shaft insertion hole 73 that supports the supporting shaft 53 is halfway inclined down rearward. Thus, when the drum subunit 50 is pushed rearward to a certain degree, the drum subunit 50 is guided further rearward owing to its own weight.

Further, as illustrated in FIG. 2B, a reference shaft 74 formed in a shape of round bar is provided behind the metal plate frames 70 so as to extend horizontally in the right-to-left direction. At a lower rear end of the drum subunit 50, a notched portion 54 is formed to engage with the reference shaft 74. FIGS. 2C and 2D are respectively a front view and a side view of the drum subunit 50 completely set between the metal plate frames 70. As illustrated in FIG. 2D, the notched portion 54 is formed at a rear end of the drum subunit 50 to be open in a laterally-facing U-shape. Due to contact between the notched portion 54 and the reference shaft 74, the rear end of the drum subunit 50 is positioned relative to the metal plate frames 70 in the vertical direction and the front-to-rear direction. It is noted that, in FIGS. 2A and 2C, some of elements provided at the rear side such as the aforementioned reference shaft 74 and below-mentioned stoppers 86 are not shown for the sake of explanatory convenience.

Between the drum subunit 50 and a lower portion of the metal plate frame 70 at each of the right and left sides, a shaft 81 is provided to extend in the front-to-rear direction. Each shaft 81 is supported by a corresponding one of the metal plate frames 70 rotatably around an axial direction thereof. A substantially rectangular parallelepiped operation part 82 is fixed to a front end of each shaft 81, and configured to swing around the shaft 81 integrally with the shaft 81. More specifically, each of the operation parts 82 is configured to swing between a first position where the operation part 82 is placed to extend up from the shaft 81 and a second position where the operation part 82 is placed to extend inward in the right-to-left direction. As illustrated in FIG. 2A, in a state where each of the operation parts 82 is set in the first position, the operation parts 82 do not disturb any operation of inserting and pulling the drum subunit 50. Thus, in this state, the drum subunit 50 can be inserted into and pulled from between the metal plate frames 70.

Figure 3B:
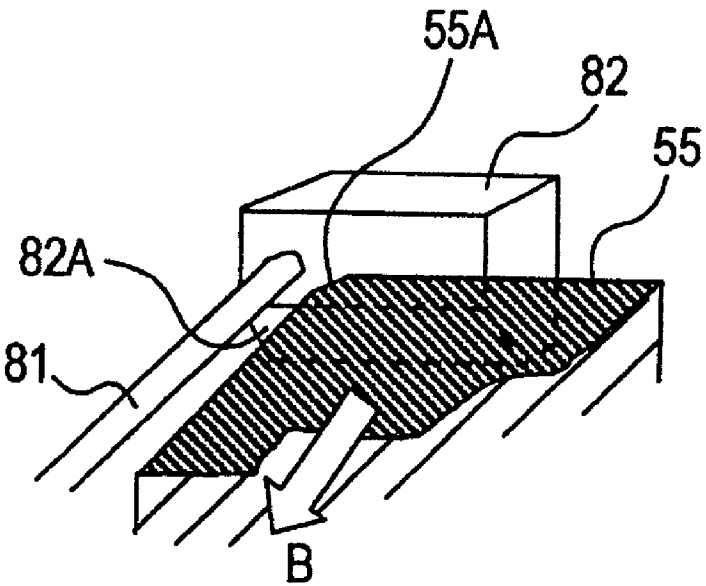
FIGS. 3A and 3B are perspective views illustrating a detailed configuration and an operation of a leg portion of the drum subunit and an operation part of the metal plate frame in the embodiment according to one or more aspects of the present invention.
Figure 3A:
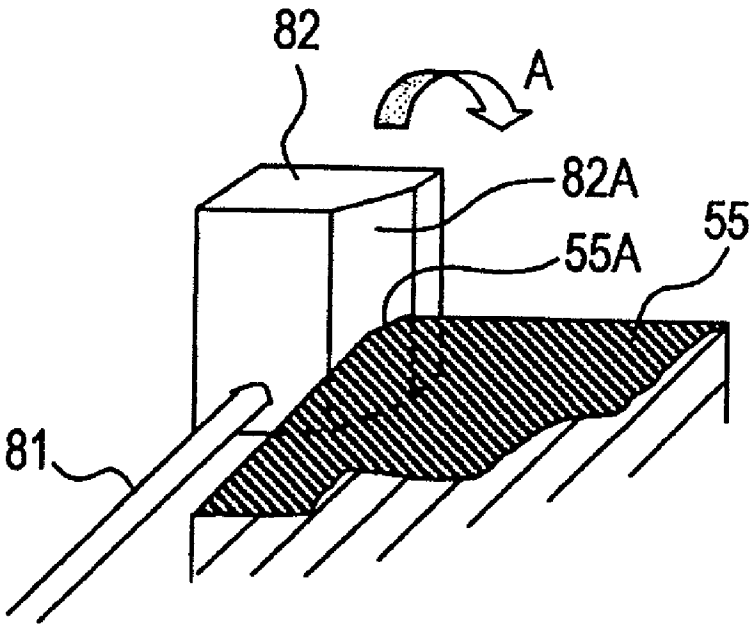

Meanwhile, when each of the operation parts 82 is swung and set to the second position with the drum subunit 50 inserted between the metal plate frames 70, the drum subunit 50 is pressed rearward so as to certainly bring the notched portion 54 into contact with the reference shaft 74. More specifically, as illustrated in FIGS. 2A to 2D, two leg portions 55 are formed at lower front ends of the drum subunit 50, so as to extend down from a lower right end and a lower left end of the drum subunit 50, respectively. As illustrated in FIG. 3, a chamfer 55A is formed at an outer front edge of each leg portion 55 in the right-to-left direction. Further, a chamfer 82A is formed at an edge which corresponds to an inner rear edge of each of the operation parts 82 set in the first position. Therefore, after the drum subunit 50 is inserted into between the metal plate frames 70, when each operation part 82 set in the first position as shown in FIG. 3A is swung in a direction indicated by an arrow A up to the second position as shown in FIG. 3B, a pressing force as indicated by an arrow B is applied to each leg portion 55. The pressing force presses the drum subunit 50 rearward to certainly bring the notched portion 54 into contact with the reference shaft 74.

Figure 4A:
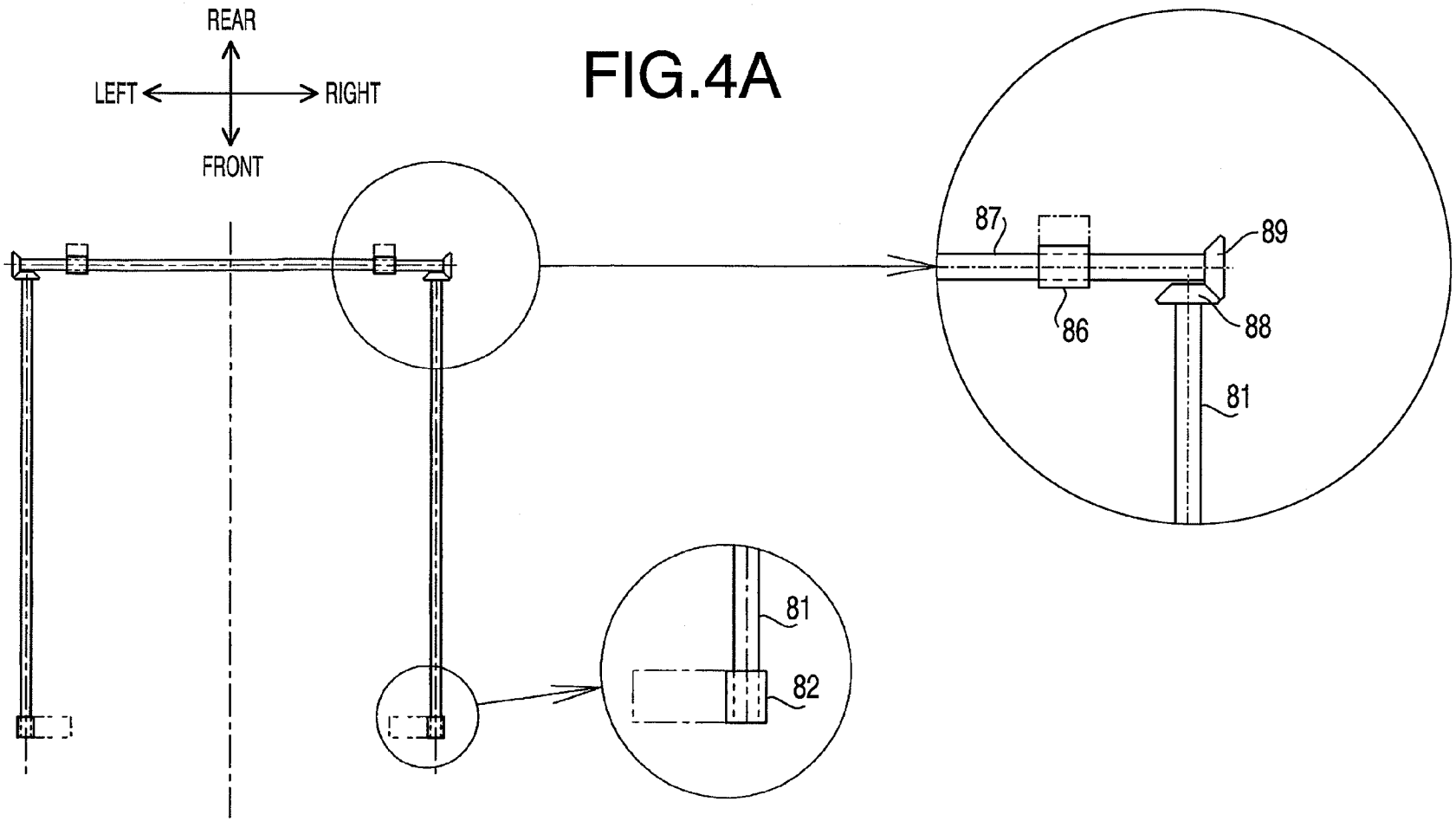
FIG. 4A is a top view showing engagement between bevel gears fixed to respective shafts immediately after the drum subunit is inserted between the metal plate frames in the embodiment according to one or more aspects of the present invention.
Figure 4B:
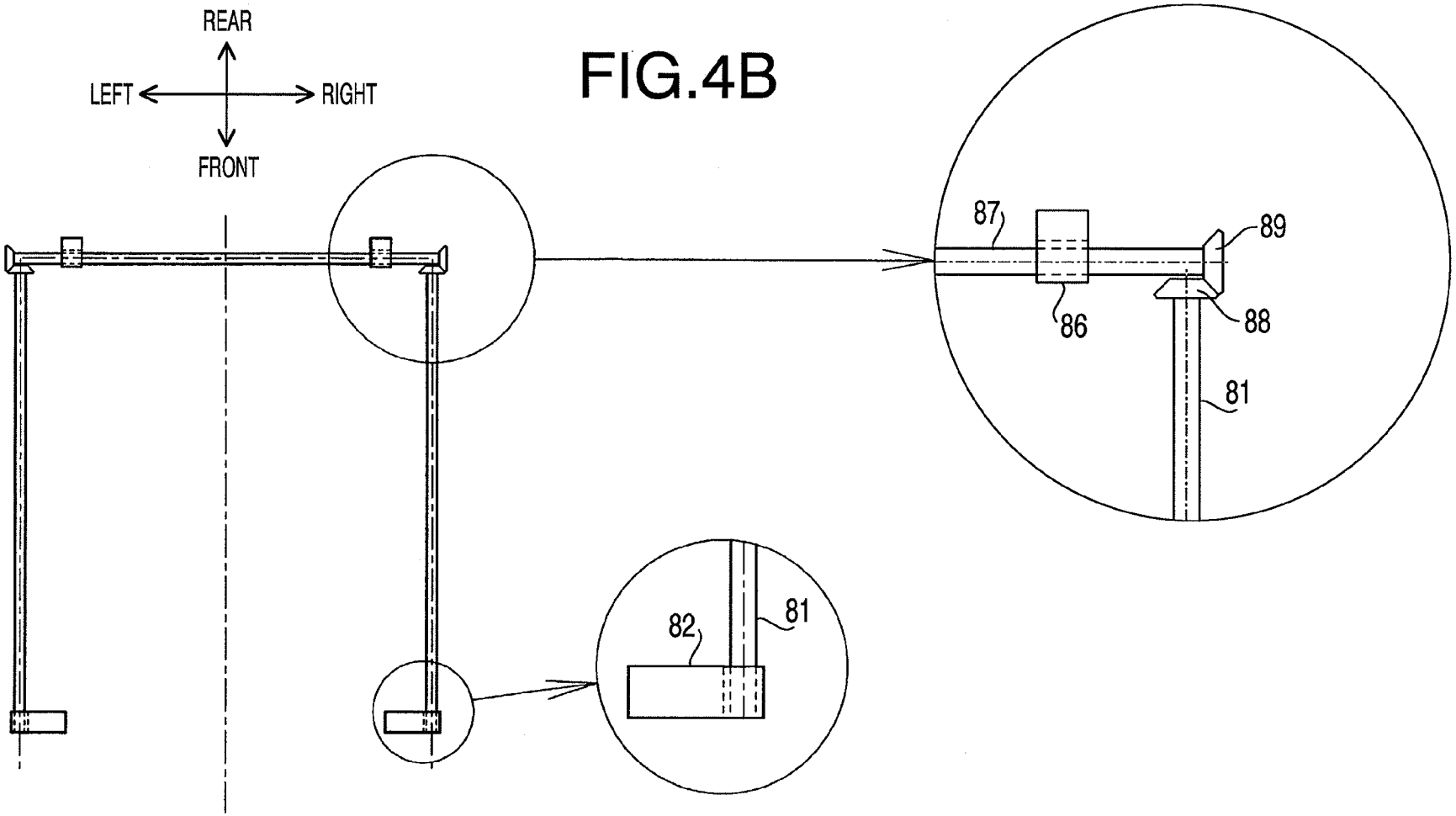
FIG. 4B is a top view showing engagement between the bevel gears fixed to the respective shafts when the drum subunit is completely set between the metal plate frames in the embodiment according to one or more aspects of the present invention.

Referring back to FIG. 2, at a lower rear end of the drum subunit 50, an engagement portion 56 is formed to be notched in an L-shape. Additionally, between the metal plate frames 70, two stoppers 86, configured to engage with the engagement portion 56, are provided swingably around a shaft 87. The shaft 87 is provided between the metal plate frames 70 to extend in the right-to-left direction and configured to rotate around an axis line thereof. The two stoppers 86 are provided to correspond to a right side portion and a left side portion of the drum subunit 50 at which the aforementioned engagement portion 56 is formed, respectively. Each of the stoppers 86 is configured substantially as a rectangular parallelepiped to swing integrally with the shaft 87. More specifically, each of the stoppers 86 is configured to swing between a first state where the stopper 86 vertically extends up from the shaft 87 as shown in FIG. 2B and a second state where the stopper 86 horizontally extends rearward from the shaft 87 as shown in FIG. 2D. As illustrated in FIGS. 4A and 4B, two bevel gears 89 are fixed to both ends of the shaft 87 in the right-to-left direction, respectively. Additionally, two bevel gears 88 are fixed to rear ends of the shafts 81, respectively. Thereby, the bevel gears 88 are respectively engaged with the bevel gears 89 at the both ends of the shaft 87 in the right-to-left direction, so as to transmit a rotational motion between the shafts 81 and the shaft 87.

Here, the engagement between the bevel gears 88 and 89 is adapted to set the stoppers 86 to the first state when the operation parts 82 are set to the first position and to the second state when the operation parts 82 are set to the second position. When the stoppers 86 are set to the first state, the stoppers 86 are engaged with the engagement portion 56 before the notched portion 56 completely comes into contact with the reference shaft 74. Meanwhile, when the stoppers 86 are set to the second state, the stoppers 86 allow the notched portion 56 to contact the reference shaft 74 without causing interference with the drum subunit 50 including the engagement portion 56.

Effects of Embodiment

According to the image forming device in the embodiment, when the two operation parts 82 are set to the first position, the drum subunit 50 can be inserted into or pulled from between the two metal plate frames 70, passing between the two operation parts 82. Moreover, at this time, the stoppers 86 are set in the first state, and thus it is possible to prevent the notched portion 54 from colliding against the reference shaft 74 when the drum subunit 50 is inserted.

Meanwhile, after the drum subunit 50 is inserted, by swinging the two operation parts 82 to the second position, the stoppers 86 are swung to the second state in conjunction with the movement of the operation parts 82. Thereby, it is possible to bring the notched portion 54 completely into contact with the reference shaft 74. Additionally, at this time, the leg portions 55 are pressed by the pressing force from the operation parts 82. Thus, it is possible to certainly bring the notched portion 54 into contact with the reference shaft 74.

Further, contrary to the operation when the drum subunit 50 is inserted, when the drum subunit 50 is pulled out, the two operation parts 82 are swung to the first position. In conjunction with the swing motions of the operation parts 82, the stoppers 86 are swung to the first state. Owing to the swing motions of the stoppers 86, the drum subunit 50 is pushed forward so as to help the user pull the drum subunit 50 more easily.

Thus, in the embodiment, the swing motions of the operation parts 82 are interlocked with the swing motions of the stoppers 86 through the bevel gears 88 and 89. Therefore, it is possible to improve the operationality of the image forming device 100. Further, since it is not necessary to provide an operation part individually for achieving each swing motion, it is possible to reduce the manufacturing cost of the image forming device 100. Moreover, since the drum subunit 50 is pushed in conjunction with the operations of the operation parts 82 for pulling the drum subunit 50, the operationality of the image forming device 100 is further improved.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of its versatility are shown and described in the present disclosure. It is to be understood that the present invention is capable of use in various other combinations and environments and is capable of changes or modifications within the scope of the inventive concept as expressed herein. For example, the following modifications are possible.

Modifications

In the aforementioned embodiment, the two stoppers 86 are provided to correspond to the right side portion and the left side portion of the drum subunit 50 at which the engagement portion 56 is formed, respectively. However, only a single stopper may be provided at a center in the right-to-left direction.

In the aforementioned embodiment, the operation parts 82 are configured to be operable directly by the user. However, a user-operable member configured to be interlocked with the operation parts 82 may separately be provided. In this case, the user-operable member may be configured to be interlocked with a pressing member for pressing another position (for example, a center in the front-to-rear direction) of the drum subunit 50 rearward. However, in this respect, since the operation parts 82 are configured to be directly operable by the user in the aforementioned embodiment, it leads to more simplified configuration and more reduced manufacturing cost of the image forming device 100 than the configuration with the user-operable member separately provided.

Further, a configuration other than the bevel gears 88 and 89 may be applied to interlock the operation parts 82 and the stoppers 86. For instance, the shafts 81 and 87 may be connected via a spring. Alternatively, a worm provided to each shaft 81 may be engaged with a worm wheel provided to the shaft 87. In this case, since a driving force is not transmitted from the stoppers 86 to the operation parts 82, it is possible to more efficiently prevent the operation parts 82 from swinging when the stoppers 86 are pressed by the drum subunit 50. However, in this respect, the aforementioned embodiment in which a driving force can be transmitted from the stoppers 86 to the operation parts 82 may present more improved operationality to achieve complete insertion of the drum subunit 50 without touching the operation parts 82. It is noted that, of course, a certain degree of resistance is desired to be caused when a driving force is transmitted from the stoppers 86 to the operation parts 82 in order to prevent the notched portion 54 from colliding against the reference shaft 74. Furthermore, the operation parts 82 and the stoppers 86 may move through sliding motions instead of the swing motions.

What is claimed is:

1. An image forming device, comprising:

a frame;

a subunit detachably attached to the frame;

a frame-side positioning portion provided to the frame;

a subunit-side positioning portion provided to the subunit, the subunit-side positioning portion being configured to position the subunit relative to the frame by establishing contact with the frame-side positioning portion;

a contact regulating member attached to the frame movably between a first location where the contact regulating member establishes contact with the subunit before the subunit-side positioning portion comes into contact with the frame-side positioning portion in process of the subunit being attached to the frame from a detached state and a second location where the contact regulating member is kept from contacting the subunit;

a pressing member attached to the frame movably between a first position where the pressing member presses the subunit in such a first direction as to bring the subunit-side positioning portion into contact with the frame-side positioning portion and a second position where the pressing member is kept from pressing the subunit; and an interlocking member configured to interlock movement of the contact regulating member to the first location with movement of the pressing member to the first position and to interlock movement of the contact regulating member to the second location with movement of the pressing member to the second position.

2. The image forming device according to claim 1, wherein the pressing member is configured to be externally operated.

3. The image forming device according to claim 2, wherein the pressing member is provided at a near side of the subunit in the first direction.

4. The image forming device according to claim 1, wherein the contact regulating member is configured to, when moving from the second location to the first location, press the subunit in a second direction opposite to the first direction.

5. The image forming device according to claim 1, wherein the interlocking member comprises a plurality of gears.

6. The image forming device according to claim 5, wherein the gears include a plurality of bevel gears.

7. The image forming device according to claim 1, wherein the subunit-side positioning portion includes a notched portion provided to the subunit, and wherein the frame-side positioning portion includes a shaft configured to, when the subunit is attached to the frame, engage with the notched portion.

8. The image forming device according to claim 1, wherein the frame comprises a guide configured to guide the subunit along the first direction when the subunit is attached to or detached from the frame.

* * * * *